US005588313A

United States Patent [19]

Hildebrand

[11] Patent Number: 5,588,313

[45] Date of Patent: Dec. 31, 1996

[54] AUTOMATIC WASHING MACHINE FITTED FOR DRYING

[75] Inventor: Gerald Hildebrand, Berlin, Germany

[73] Assignee: Bosch-Siemens Hausgeraete GmbH, Munich, Germany

[21] Appl. No.: 542,671

[22] Filed: Oct. 13, 1995

[30] Foreign Application Priority Data

Oct. 13, 1994 [DE] Germany ..... 44 36 673.6

[51] Int. Cl.[6] ..... D06F 25/00; D06F 39/02

[52] U.S. Cl. ..... 68/17 R; 68/20

[58] Field of Search ..... 68/17 R, 20; 134/93

[56] References Cited

U.S. PATENT DOCUMENTS

| | | | |
|---|---|---|---|
| 2,957,330 | 10/1960 | Cline | 68/20 |
| 5,207,764 | 5/1993 | Akabane et al. | 68/20 |

FOREIGN PATENT DOCUMENTS

| | | | |
|---|---|---|---|
| 230071 | 4/1959 | Australia | 68/20 |
| 0499029 | 8/1992 | European Pat. Off. | 68/17 R |
| 3403628 | 8/1985 | Germany | 68/17 R |
| 242094 | 9/1989 | Japan | 68/17 R |
| 2262595 | 6/1993 | United Kingdom | 68/17 R |

*Primary Examiner*—Philip R. Coe
*Attorney, Agent, or Firm*—Herbert L. Lerner; Laurence A. Greenberg

[57] ABSTRACT

An automatic front-loading washing machine includes a tub having a lower portion, a lowest point and a fill opening with an air inlet neck. A tub drain is connected to the lowest point of the tub. A detergent dispenser has a multiplicity of chambers. A detergent supply line leads into the lower portion of the tub. A closed air recirculation circuit is associated with the tub for drying and includes a waste air conduit leading out of the tub and having a condensation device, a blower, a heating conduit, and an air inlet conduit opening into the air inlet neck to the fill opening of the tub. The waste air conduit and the detergent supply line are one component and dehumidified waste air is carried outside the chambers through the detergent dispenser to the blower.

13 Claims, 3 Drawing Sheets

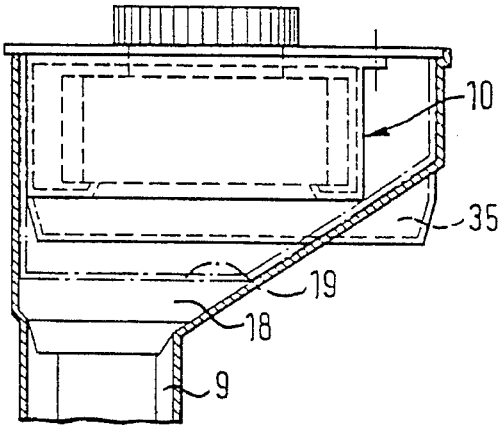
FIG. 2
FIG. 3
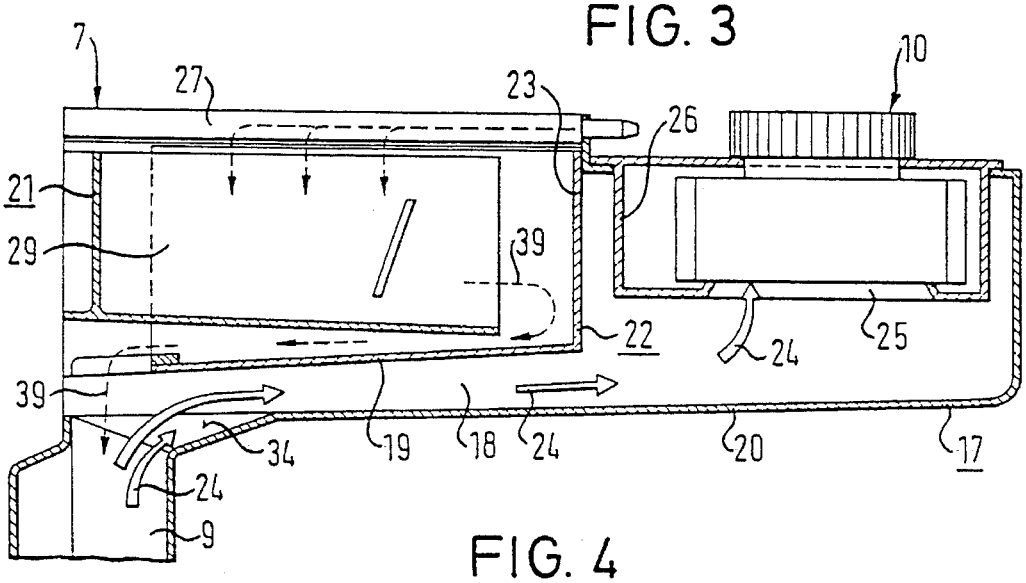
FIG. 4
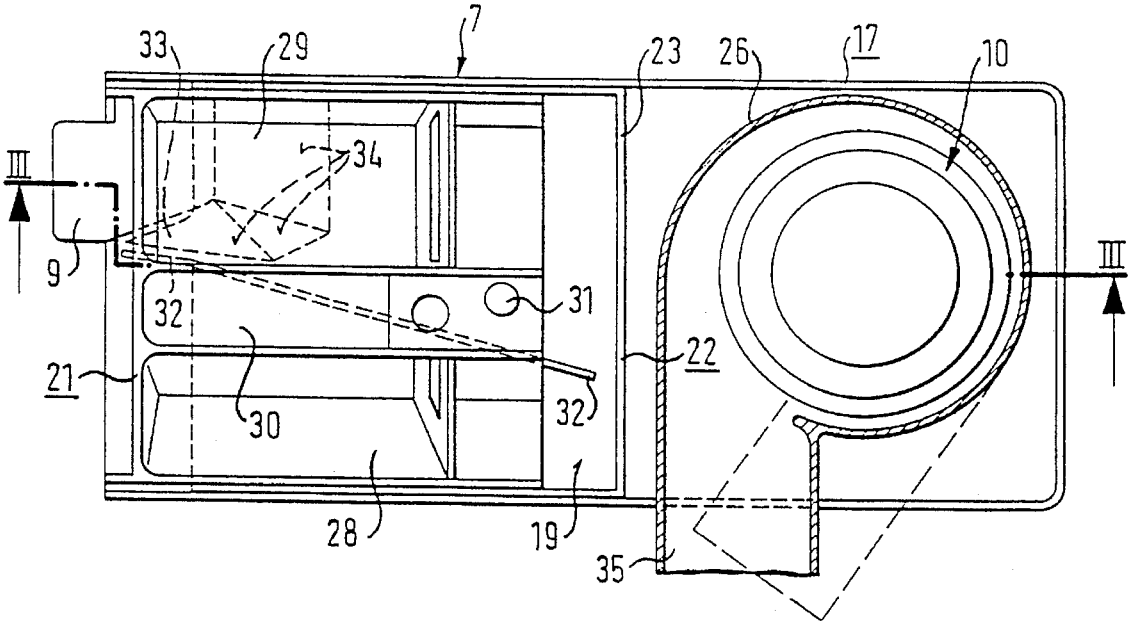

AUTOMATIC WASHING MACHINE FITTED FOR DRYING

BACKGROUND OF THE INVENTION

Field of the Invention

The invention relates to an automatic front-loading washing machine, which includes a multiple-chamber detergent dispenser with a detergent supply line leading into a lower portion of a tub that is connected at its lowest point to a tub drain and which is also fitted for drying and to that end has a closed air recirculation circuit which includes a waste air conduit leading out of the tub and having a condensation device, a blower, a heating conduit, and an air inlet conduit opening into an air inlet neck to a fill opening of the tub.

That kind of washing machine which is fitted for drying is described in German Published, Non-Prosecuted Application DE 41 04 760 A1. On the right-hand side of the tub shown therein, a special condenser conduit is coupled to a lower region, and a stream of cooling water from a special cooling water nozzle acts essentially vertically thereon. The nozzle can be supplied from the household water supply through an additional magnetic valve. The warm, moist process air fed by the blower is aspirated in countercurrent to the cooling water stream through the condenser conduit and is dehumidified by the cold cooling water stream. Although the blower for feeding the process air and the heating conduit for heating the process air upstream of the inflow into the laundry drum are indispensable, nevertheless, the other expense and complication (condenser conduit, cooling water nozzle, magnetic valve, connecting hose, additional opening in the tub) result in increased expense that the invention seeks to avoid, without worsening the ease of use of the washing machine thereby.

SUMMARY OF THE INVENTION

It is accordingly an object of the invention to provide an automatic washing machine fitted for drying, which overcomes the hereinafore-mentioned disadvantages of the heretofore-known devices of this general type.

With the foregoing and other objects in view there is provided, in accordance with the invention, an automatic frontloading washing machine, comprising a tub having a lower portion, a lowest point and a fill opening with an air inlet neck; a tub drain connected to the lowest point of the tub; a detergent dispenser having a multiplicity of chambers; a detergent supply line leading into the lower portion of the tub; a closed air recirculation circuit being associated with the tub for drying and including a waste air conduit leading out of the tub and having a condensation device, a blower, a heating conduit, and an air inlet conduit opening into the air inlet neck to the fill opening of the tub; the waste air conduit and the detergent supply line being the same component; and dehumidified waste air being carried outside the chambers through the detergent dispenser to the blower.

The thus-accomplished combination of the courses or paths for supplying the detergent and for dehumidifying the process air, which are only needed at different segments of the process within the washer-dryer, leads to considerable structural simplification of the machine and reduces the number of components needed for that purpose.

For instance, the separate condenser conduit with its devices for supplying and distributing the cooling water, a separate magnetic valve, and a hose between the condenser conduit and the magnetic valve are omitted. Moreover, an additional opening in the tub, which leads to special expenses and sealing problems due to its sealing provisions, can be omitted.

An additional advantage of the provisions of the invention is attained because combining the waste air conduit and the detergent supply line reduces the deposition of lint without requiring additional expense for rinsing the condenser conduit. Since the waste air conduit is used at the same time as a detergent supply line, all of the water for operating the washer-dryer is carried over the same course or path and thus automatically rinses out any lint deposited in that line. Another result of the absence of an additional opening in the tub for the connection of the condenser conduit is that the tub of the washer-dryer need not differ from the tub of a washing machine of the same system, so that the same tub can be used for both types of machine.

In accordance with another feature of the invention, the detergent dispenser which includes chambers disposed in a drawer and is guided so as to be removable to the front with the drawer in a housing including a false bottom, side, back and top walls, is further constructed in such a way that the waste air is carried beneath the false bottom and above a lower bottom, which is disposed between the detergent supply line and the blower and is a component of a connecting air guide conduit.

To that end, the blower housing is suitably constructed in one piece with the housing for the detergent dispenser, and a false bottom is inserted which divides the dehumidified waste air from the wet portion of the detergent dispenser.

In accordance with a further feature of the invention, the false bottom is a one-piece structure with the rear wall, which can both be removed together from the housing toward the front. As a result, with the detergent drawer removed from a hollow space in the housing, the false bottom wall and the back wall can be removed, so that the hollow space in the housing is easily accessible, for instance for cleaning purposes.

In accordance with an added feature of the invention, due to the typical spatial layout in washing machines, it is especially advantageous if the blower is disposed spatially behind the detergent dispenser in the air guide conduit.

In accordance with an additional feature of the invention, the air guide conduit is integral with the detergent supply line, surrounds the detergent dispenser from below and is spaced apart from the detergent dispenser.

Cooling devices may be provided that are acted upon by externally supplied coolant air for cooling the moisture-laden waste air in the waste air conduit.

In accordance with yet another feature of the invention, in addition or instead, the washing machine according to the invention may have a water-cooled condensation device in the waste air conduit, the cooling water of which device can be supplied through at least one of the detergent chambers. As a result, one or more magnetic valves that are needed anyway for dispensing detergent can be used in the drying segment of the wash cycle for supplying cooling water. The outlet of the detergent dispenser discharges into the upper region of the detergent supply line anyway, which at the same time contains the condensation devices, since it is a waste air conduit as well. The cooling water courses or paths are therefore the same as those taken when detergent is dispensed.

In accordance with yet a further feature of the invention, there are provided liquid guide devices on the top of the false bottom, which on one hand are disposed below the opening of whichever chamber or chambers is supplied with cooling water, and on the other hand discharge above liquid distributor devices at the upper inlet to the detergent supply line/waste air conduit. The liquid guide devices may be constructed as ribs or grooves on the top of the false bottom. In order to prevent detergent from being able to be deposited, to the maximum possible extent the liquid distributor devices should be only in the form of gently curved bottom structures at the transition between the lower bottom and the upper inlet of the waste air conduit.

In accordance with yet an added feature of the invention, the liquid distributor devices distribute the cooling water uniformly over the downward-pointing walls of the waste air conduit under the influence of gravity and the forces of adhesion as well as counter to the action of force from the surrounding air stream.

In accordance with yet an additional feature of the invention, in order to act as an odor lock for the "wash" portion of the process cycle, the washing machine according to the invention can advantageously have a siphon with a water trap as a component of its liquid distributor devices, the siphon discharges on the inlet side freely below the outlets of the liquid guide devices and on the outlet side discharges freely into the detergent supply line/waste air conduit. By supplying cooling water or water used for the washing process, the siphon is kept constantly filled and therefore performs its task as an odor lock.

In accordance with again another feature of the invention, for odor closure, before its connection with the tub, the detergent supply line discharges into a tube bend with a water trap that is effective if there is washing liquid available in the tub, and the lowermost region of the tube bend communicates with the tub drain through a liquid line. The disposition of a siphon-like tube bend at the transition between the detergent dispenser line and the tub is intrinsically conventional. However, this feature of the washing machine according to the invention includes the liquid line in the lowermost region of the tube bent which communicates directly with the drain line and is filled in any case with suds during the washing process that is the source of odors. Since at the end of the wash, rinse and spin process this tube bend is pumped empty through the additional liquid line, the tube bend can be freed of the water trap so that it becomes open to the recirculating air required for the drying process.

In accordance with again a further feature of the invention, the coolant inflow is disposed through whichever chamber serves to receive liquid laundry additives and has a device that delays drainage, for instance a suction lifter at the outflow opening. As a result, the cooling water flows more uniformly down the walls of the waste air conduit and improves the condensation action.

In accordance with a concomitant feature of the invention, the cooling water is supplied at a cadence, cycle or phase that is adapted to the outflow speed of the cooling water from the chamber and to the outflow speed of the cooling water out of the waste air conduit. This provision further improves the uniformity of the cooling and condensation action.

Other features which are considered as characteristic for the invention are set forth in the appended claims.

Although the invention is illustrated and described herein as embodied in an automatic washing machine fitted for drying, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 2–4 are various fragmentary, sectional views of an embodiment for integrating a detergent dispenser, a blower, a waste air conduit and an air guide conduit, with FIG. 3 being taken along a line III—III of FIG. 4, in the direction of the arrows;

DESCRIPTION OF THE PREFERRED EMBODIMENTS

Figure 1:
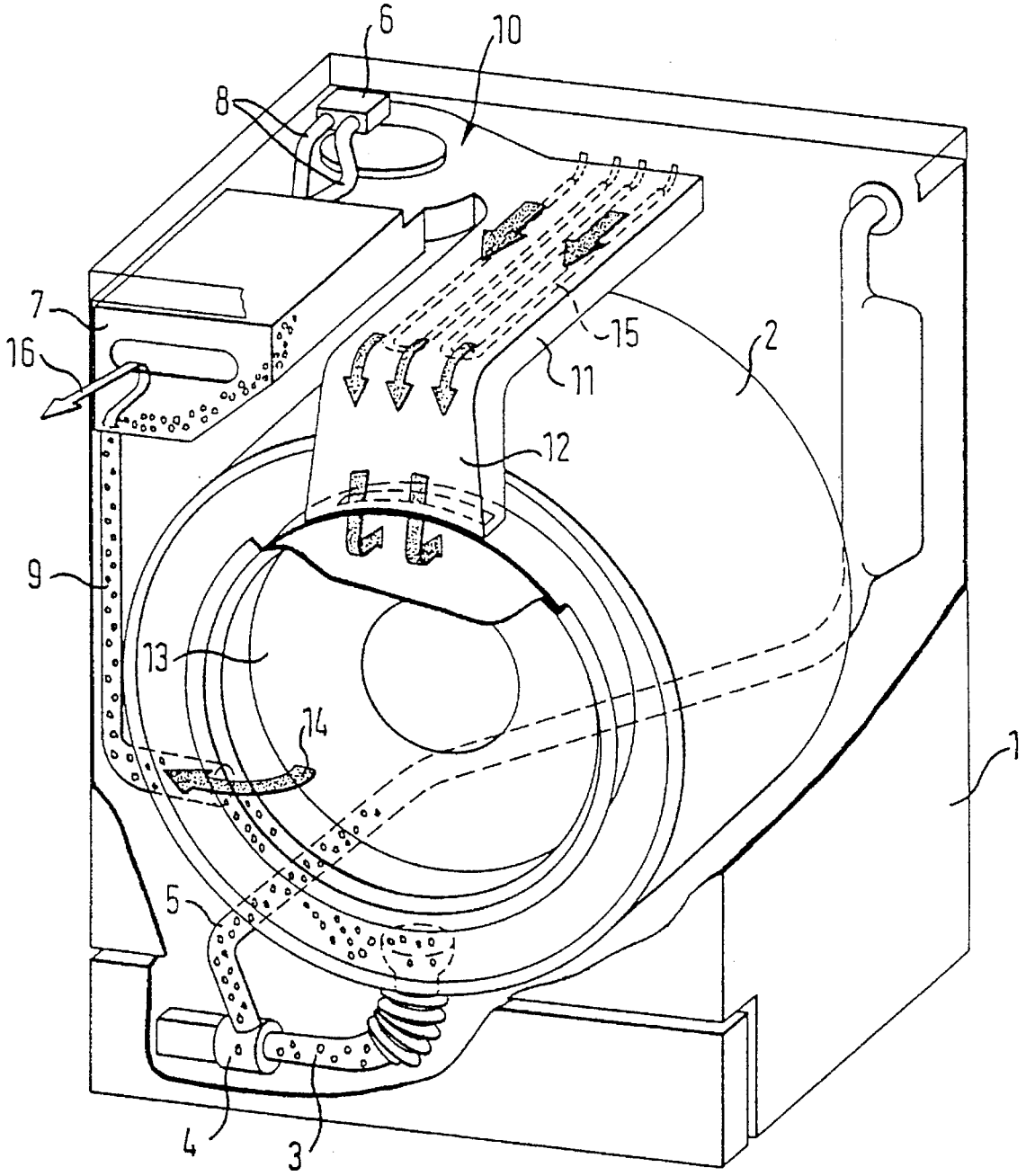
FIG. 1 is a diagrammatic, partly broken-away, perspective view of a washer-dryer equipped according to the invention.

Referring now to the figures of the drawing in detail and first, particularly, to FIG. 1 thereof, there is seen a tub 2 which is disposed inside a machine housing 1 and is in the form of a drying chamber for laundry that is located in a non-illustrated laundry drum which is rotatably supported horizontally in the tub. A tub drain 3 with a pump 4 and a drain conduit 5 is coupled to the lowest point of the tub. In order to supply water and detergent for a wash cycle, a double magnet valve 6 and a detergent dispenser 7 with connecting hoses 8 to the magnet valve 6 are disposed in the upper left-hand portion of the washing machine. Water can be supplied through the hoses 8 through whichever magnet valve 6 is switched on, into chambers which are not shown in FIG. 1, for either prewash detergents or main wash detergent, or if both magnet valves are switched on, then water can be supplied to a third chamber for fabric softener through both hoses 8. The laundry additives may be carried in a known manner from chambers of the detergent dispenser 7 through a bottom disposed in a housing of the dispenser to a detergent supply line 9, which carries the water or a mixture of water and detergent into a lower region of the tub 2.

In order to fit or equip the washing machine for drying, a blower 10 and a heating conduit 11 are also provided, with the latter communicating with the tub 2 through an air supply conduit 12 and a fill opening 13. The blower 10 can aspirate waste air 14 from the tub through the detergent supply line 9 and through the detergent dispenser 7 and deliver it to the heating conduit 11. Heating bars 15, which resupply heat to the air in order to make it absorbent to an increased extent for moisture from the damp laundry in the laundry drum, are disposed inside the heating conduit 11. This closes the air recirculation circuit.

In a manner which is not shown in further detail in FIG. 1, moisture is extracted inside the detergent supply line 9 from the waste air 14 that has left the tub 2. To that end, the detergent supply line 9 is also equipped as a waste air conduit that is constructed as a condensation device, to which cooling water is supplied from the detergent dispenser 7 when one or more magnet valves are turned on. Since drying cycles occur only when the chambers of the detergent dispenser 7 have already been emptied during a preceding wash cycle, the cooling water guided through the same chambers does not contain any proportion of detergent. During the drying cycle, it trickles down through the detergent supply line 9 being constructed as a condensation device at that location and it extracts the moisture from the process air. The cooling water and the condensate travel jointly to the bottom of the tub 2 and are carried out of the machine by the pump through the drain 3 and through the outflow line or drain conduit 5. During heating by the heating bars 15, the volume of air located in the air recirculation circuit increases. In order to prevent an overpressure from arising within the air recirculation circuit, a waste air course 16 is present in the usual way in the detergent dispenser 7, and this course is also effective in the opposite direction again as an air supply course during cooling down of the system.

In accordance with a proposed further feature of the washing machine according to the invention, the detergent dispenser 7 is accommodated with the blower 10 in a common housing 17, as is shown in FIGS. 2–4. This housing is connected to the front of the detergent supply line 9 and also includes an air guide conduit 18, which is defined by a false bottom wall 19 of the detergent dispenser and a lower bottom 20 of the housing 17. The false bottom 19 is a component of a housing part 22, which is removable to the front from a hollow space in the housing after a detergent drawer 21 has been removed. The housing part 22 also includes a back wall 23. It too serves to guide the process air indicated by arrows 24, which is finally carried to an intake opening 25 of the blower 10. In FIG. 2, the hollow space in the blower 10 can be seen in the rear portion once the housing part 22 has been removed. In the lateral view through the apparatus of FIG. 3 and the plan view of FIG. 4, the spiral housing 26 of the blower 10 can be seen to be disposed directly behind the detergent dispenser 7 in the common housing 17.

In order to supply detergent rinse water and cooling water, a top wall 27 that is integrated with the common housing 17 and equipped with water guide conduits is provided. The top wall 27 has a lower surface with openings oriented into the chambers of the drawer 21. The water passes through the chambers to a rear portion of the drawer 21 and there runs over the inclined false bottom wall 19 toward the front and finally trickles into the detergent supply line 9. The line 9 is equipped with devices that put the cooling water indicated by arrows 39 into intensive contact with the process air indicated by arrows 24 flowing in countercurrent to it, in a manner which is not shown in detail herein. As a result, a considerable portion of the moisture from the process air condenses at the cooling water and is carried downward together with it and removed from the machine in the manner described above.

With the top wall 27 removed as in FIG. 4, it is possible to see into the chambers 28–30 of the detergent drawer 21. The chamber 28 serves to hold and dispense a metered amount of prewash agent, the chamber 29 is for a metered amount of main detergent, and the chamber 30 is for a metered amount of liquid fabric softener. A suction lifter 31 which is disposed at the back of the chamber 30 gradually removes the residual water from the chamber 30 by suction and carries it to the false bottom 19. The spiral housing 26 of the blower is visible with the blower removed and with an integrated lid.

Since as a rule the flow rates of water per unit of time are dimensioned generously for rinsing detergent out of the chambers but on the other hand are much too large for cooling a condensation device, it is not recommended that the cooling water be supplied to the chambers 28 or 29. Such water would in fact flow onward from them without delay. The requisite low flow quantity per unit of time could be attained there only if a switchable throttling of the inflow quantity during cooling water operation were provided between the magnet valve 6 and the detergent dispenser 7. It is more advantageous to supply cooling water into the already rinsed fabric softener chamber 30. Two seconds of opening time for the magnet valves 6 would suffice to fill that chamber up to an overflow curve of the suction lifter 31. Within 20 to 30 seconds, the filled chamber 30 would automatically empty and a two-second inflow sequence would have to follow that again.

In order to assure that the supplied cooling water will reach preferred locations of the mouth of the detergent supply line 9, with the locations being dependent on the disposition of condensation devices within the detergent supply line, liquid guide devices 32 which are provided on the top of the false bottom 19, can be injection molded directly onto the false bottom 19. The front edge of the false bottom 19 can be approximately adapted to the profile of the detergent supply line 9. The result in the present case is a forward-projecting protuberance 33, which approximately follows the inclined wall of the supply line 9 and is also laterally bounded by the liquid guide device 32. On the lower bottom 20, the connection region to the detergent supply line 9 may be constructed as a liquid distributor device by providing the connection region with suitable inclined surfaces 34, which assure that the cooling water draining from the front edge and the protrusion 33 of the false bottom wall 19 will be distributed over a wide surface area to the detergent supply line 9.

A compressed air neck 35 of the blower spiral 26 may be located in any suitable way for delivery to the heating conduit 11. Two of the possible positions are shown herein. In the position shown in dashed lines, an opposite direction of rotation of a fan wheel is needed, in comparison with the position shown in solid lines.

Figure 5:
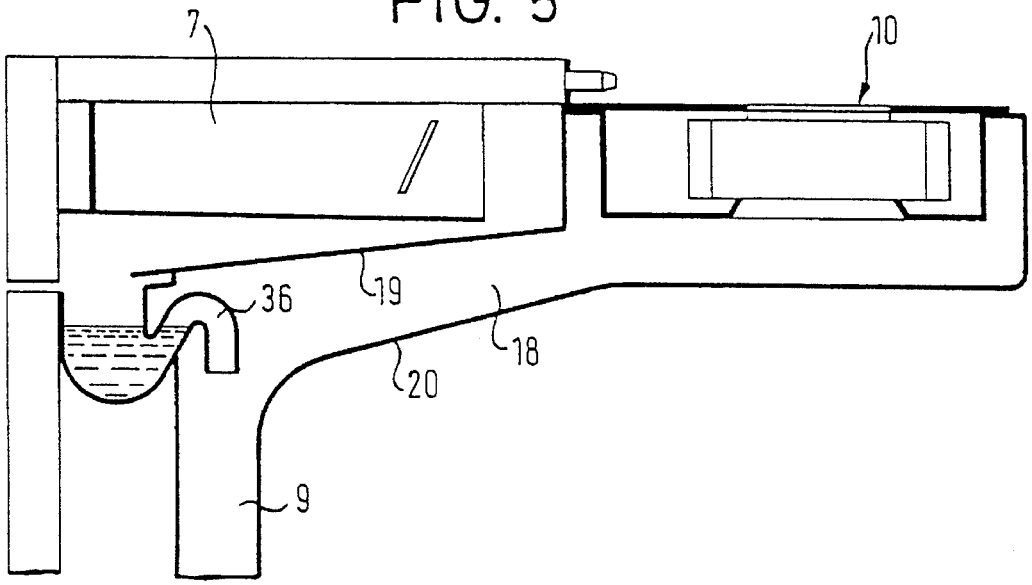
FIG. 5 is a fragmentary, elevational view showing a siphon for a water trap at an outlet of the detergent dispenser.

In washing machines, it is usual to build in a water trap into the detergent supply line as an odor lock in order to prevent fumes that would escape to the outside, for instance through the detergent supply line and the detergent dispenser, if the fluid in the washing machine underwent severe heating. FIG. 5 shows one option for a way in which such an odor lock can nevertheless be accomplished for the washing mode, given a combination of the detergent supply line and the waste air conduit 9, which must naturally be free for the recirculating air in the drying mode or in other words must then not have any odor lock. To that end, the false bottom 19 ends above a siphon 36 having an outlet which opens freely into the detergent supply line or waste air conduit 9. Supplied detergent and cooling water can both pass through the water trap in the siphon 36 into the detergent supply line or waste air conduit 9.

Figure 6:
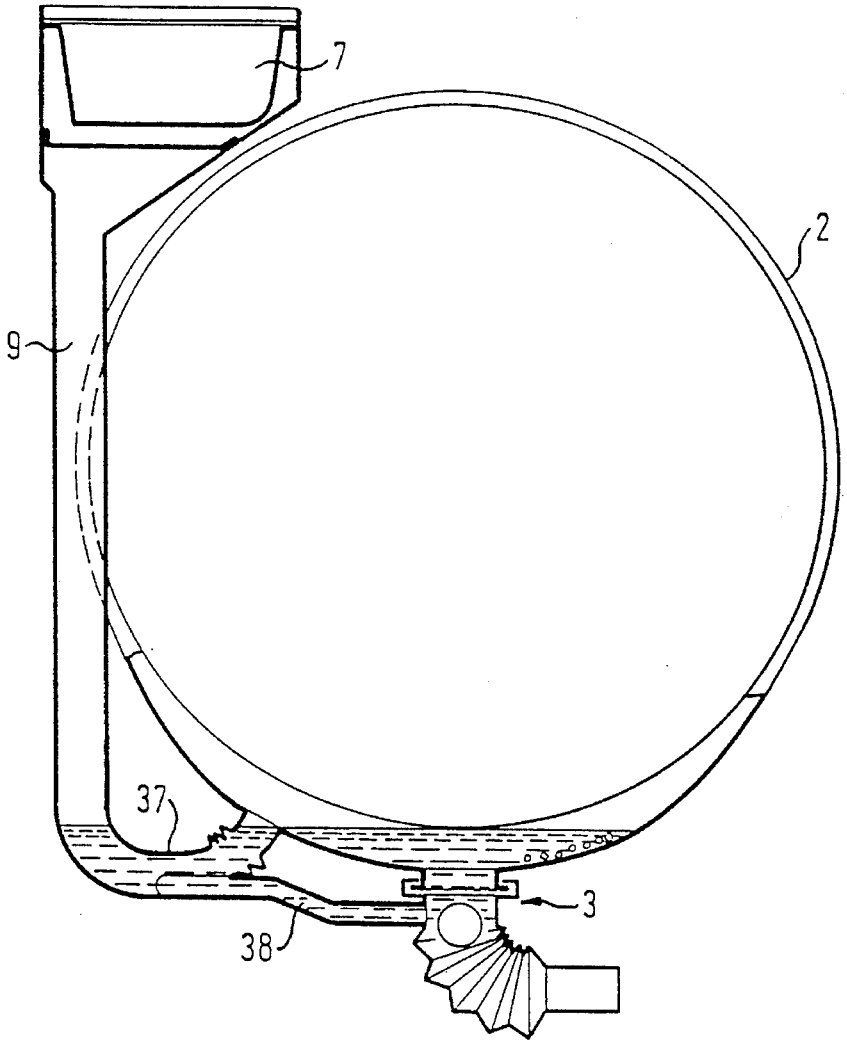
FIG. 6 is an elevational view showing an embodiment of an odor lock at an outlet-side end of a detergent supply line.

Another option for forming an odor lock to prevent fumes from the tub is obtained by a further embodiment of a tube bend 37, that is known per se, at the end of the detergent supply line 9. However, a known tube bend would still have the water trap at the beginning of the drying cycle and it would form a lock against the process air. Conversely, a liquid line 38 according to the invention provides a remedy, by communicating on one end with the lowermost region of the tube bend 37 and on the other with the tub drain 3. Through this line 38, the tube bend is likewise pumped empty at the end of the wash cycle. As a result, the tube bend 37 becomes free for the passage through it of the process air to the waste air conduit 9 and to its non-illustrated condensation device. In both FIGS. 5 and 6, the parts of the washing machine according to the invention that are not needed for explaining the exemplary embodiments with the disposition of a water trap have been omitted.

As a deviation from the exemplary embodiments shown, the provisions according to the invention can be logically adapted to a top-loading washing machine as well.

I claim:

1. An automatic front-loading washing machine, comprising:

a tub having a lower portion, a lowest point and a fill opening with an air inlet neck;

a tub drain connected to said lowest point of said tub;

a detergent dispenser having a multiplicity of chambers;

a detergent supply line leading into said lower portion of said tub;

a closed air recirculation circuit being associated with said tub for drying and including a waste air conduit leading out of said tub and having a condensation device, a blower, a heating conduit, and an air inlet conduit opening into said air inlet neck to said fill opening of said tub;

said waste air conduit and said detergent supply line being one component; and dehumidified waste air being carried outside said chambers through said detergent dispenser to said blower.

2. The washing machine according to claim 1, wherein said detergent dispenser includes a housing part having a front, a false bottom, side, back and top walls, and a drawer in which said chambers are disposed, said drawer being guided in said housing part to be removable toward said front; and including a connecting air guide conduit having a lower bottom disposed between said detergent supply line and said blower, waste air being carried beneath said false bottom and above said lower bottom.

3. The washing machine according to claim 2, including a housing, said false bottom being integral with said back wall and being removable from said housing toward said front jointly with said back wall.

4. The washing machine according to claim 2, wherein said blower is disposed spatially behind said detergent dispenser in said air guide conduit.

5. The washing machine according to claim 4, wherein said air guide conduit is integral with said detergent supply line, surrounds said detergent dispenser from below and is spaced apart from said detergent dispenser.

6. The washing machine according to claim 2, wherein said condensation device in said waste air conduit is cooled with cooling water being supplied through at least one of said detergent chambers.

7. The washing machine according to claim 6, wherein said false bottom has a top, said chambers have openings for receiving cooling water, said detergent supply line/waste air conduit component has an upper inlet, and including liquid distributor devices at said upper inlet to said detergent supply line/waste air conduit component, and liquid guide devices disposed on said top of said false bottom, said liquid guide devices being disposed below said opening of at least one of said chambers being supplied with cooling water, and said liquid guide devices discharging above said liquid distributor devices.

8. The washing machine according to claim 7, wherein said waste air conduit has downward-pointing walls, and said liquid distributor devices are shaped for distributing the cooling water uniformly over said downward-pointing walls under the influence of gravity and forces of adhesion and counter to an action of force from a surrounding air stream.

9. The washing machine according to claim 7, wherein said liquid guide devices have outlets, and said liquid distributor devices have a siphon with a water trap, said siphon discharging on one end freely below said outlets of said liquid guide devices and having an outlet side discharging freely into said detergent supply line/waste air conduit component.

10. The washing machine according to claim 6, wherein one of said chambers receives liquid laundry additives, the cooling water inflow passes through said one chamber, and including a device for delaying drainage.

11. The washing machine according to claim 10, wherein said device for delaying drainage is a suction lifter at a drain opening.

12. The washing machine according to claim 10, wherein the cooling water can be supplied in a cycle being adapted to an outflow speed of the cooling water from said chamber and to an outflow speed of the cooling water out of said waste air conduit.

13. The washing machine according to claim 1, including a tube bend having a lowermost region and a water trap being effective if washing liquid is available in said tub, said detergent supply line discharging into said tube bend upstream of a connection between said detergent supply line and said tub, and a liquid line through which said lowermost region of said tube bend communicates with said tub drain.

* * * * *